United States Patent [19]

Limousin

[11] Patent Number: 4,586,312

[45] Date of Patent: May 6, 1986

[54] METHOD FOR PRODUCING HEAT SHRINKABLE PACKAGE WITH A FRANGIBLE ACCESS PANEL

[75] Inventor: Jean-Louis Limousin, Clearwater, Fla.

[73] Assignee: Pet Incorporated, Fenton, Mo.

[21] Appl. No.: 595,581

[22] Filed: Apr. 2, 1984

[51] Int. Cl.[4] ..... B65B 61/18

[52] U.S. Cl. ..... 53/412; 53/415; 53/442; 493/363; 493/963

[58] Field of Search ..... 53/133, 228, 229, 412, 53/442, 553, 557, 415, 410; 206/611, 614, 499, 459, 623, 624, 626; 493/63, 212, 363, 963

[56] References Cited

U.S. PATENT DOCUMENTS

| | | | |
|---|---|---|---|
| 2,847,915 | 8/1958 | Rapp | 493/212 |
| 3,286,830 | 11/1966 | Robb, Jr. | 206/626 |
| 3,309,789 | 3/1967 | Denker | 53/557 |
| 3,640,049 | 2/1972 | Fritz et al. | 53/557 |

FOREIGN PATENT DOCUMENTS

| | | | |
|---|---|---|---|
| 118655 | 1/1942 | Australia | 206/626 |
| 7313549 | 4/1974 | Netherlands | 53/412 |
| 388872 | 3/1933 | United Kingdom | 206/626 |
| 1397709 | 6/1975 | United Kingdom . | |

*Primary Examiner*—James E. Coan

*Attorney, Agent, or Firm*—Frijouf, Rust & Pyle

[57] ABSTRACT

An apparatus and method is disclosed for providing a heat shrinkable package with a frangible access panel therein defined by perforations disposed in the heat shrinkable package. A novelty of the method and apparatus resides in the perforation of the heat shrinkable material prior to passing the package through a heat shrink oven. The package is oriented on a conveyor with the perforations adjacent to the conveyor, enabling the perforated portion of the package to be subjected to less heat than the remainder of the package, enabling formation of the heat shrink package without severing the perforations defining the access panel.

3 Claims, 10 Drawing Figures

METHOD FOR PRODUCING HEAT SHRINKABLE PACKAGE WITH A FRANGIBLE ACCESS PANEL

BACKGROUND OF THE INVENTION

1. Field of the Invention

This invention relates to packaging and more particularly to a heat shrink package having perforations for providing a frangible access panel defined by perforations in the heat shrink package.

2. Description of the Prior Art

The art of heat shrink wrapping has provided many novel and inexpensive packages over the last decade. Typically, a single article or an array of articles are located on a conveyor and are loosely wrapped with a plastic material such as polyethylene which will shrink upon the application of heat. The article or articles wrapped with the heat shrinkable material are passed through a heat shrink oven to cause shrinking of the plastic material to thereby conform to the outer dimensions of the article or articles. The heat shrink package provides a protective covering for the article or articles, as well as a mechanical package for holding the plurality of articles in an array.

Some in the prior art have found it necessary to remove a portion of the shrink wrap package for applying price markings or tax stamps to the article or array of articles enclosed within the shrink wrap package. For example, cigarette packs or other packages requiring tax stamps are preferably packaged in a carton array with a removable panel disposed on one edge. The panel may be removed and the tax stamp applied to each of the array of articles while the articles are still maintained in the shrink wrap package. Similarly, articles to be sold in retail outlets may be conveniently price marked through the use of a removable panel prior to the removal of the individual articles from the heat shrink package.

U.S. Pat. No. 3,016,131 to Kennedy discloses a heat shrink package of polymetric film which is provided with a desired slit pattern which opens when stretched in the heat shrinking process.

U.S. Pat. No. 3,047,140 to Robins teaches a shrink wrap package of a plurality of articles with perforations to permit ready detachment of a single article from the package.

U.S. Pat. No. 3,071,244 to Doran discloses the desirability of having portions of tobacco packages accessible for the application of tax stamps while the packages are maintained in a group package.

U.S. Pat. No. 3,027,300 to Farmer relates to the shrink wrapping of bananas, which are wrapped between an upper and a lower polymetric web. The webs are heat sealed and the film is shrunk about the articles. Pin hole perforations are provided in one of the webs prior to the heating operation, permitting the escape of air from the package as the film shrinks thereabout.

U.S. Pat. No. 3,273,302 to Walter illustrates a carton which is wrapped within a single sheet of polymetric film and heated to provide the heat shrink package. A tool is applied to form a tear tab in the already heat shrunk package to facilitate opening thereof after the package has been passed through a a heat shrink oven.

U.S. Pat. No. 3,326,369 to Tolaas, et al. discloses a cardboard carton provided with a pattern of perforations for the specific purpose of providing individual access to the plurality of individual boxes in the package to facilitate price marking on each box.

U.S. Pat. No. 3,344,975 to Stoker, Jr. discloses a shrink wrap package with a tear tab in the shrink wrap material to serve as a started for tearing the shrink wrap material to open the package.

U.S. Pat. No. 3,357,153 to Shaffer discloses a heat shrink oven wherein the heated air may be recirculated for efficient operation.

U.S. Pat. No. 3,442,436 to Kirby, Jr. provides a shrink wrap package with a pair of tab means in the shrink wrap material, enabling the tabs to be pulled to open the package.

U.S. Pat. No. 3,488,912 to Christian relates to the use of a stream of gas to cool a heat seal, whereby the heat seals on the adjacent packages are prevented from contacting each other until the heat seals have cooled below a setting temperature.

U.S. Pat. No. 3,545,165 to Greenwall teaches the method of severing a package into package components along perforations by heat shrinking.

U.S. Pat. No. 3,542,193 to Hewlett provides a heat shrinkable material in combination with a shallow tray for covering one end of articles contained in the heat shrink package.

U.S. Pat. No. 3,640,049 to Fritz, et al. incorporates a heat shrink machine incorporating the cooling of a conveyor belt.

U.S. Pat. Nos. 3,654,829 and 3,804,235 to Anderson provide a punching mechanism for punching a heat shrinkable material prior to heating, to enable the application of tax stamps to tobacco packages.

U.S. Pat. No. 3,834,525 to Morgese teaches a shrink wrap package incorporating two spaced parallel slits in registry with the edges of the containers within the package.

U.S. Pat. No. 3,895,713 to Bunnell discloses a container package having a tray in combination with a plastic covering having apertures therein for enabling the containers to be individually removed from the package.

The aforementioned prior art have solved many of the needs of the prior art shrink wrap packages, but each has many distinct disadvantages. The prior art utilizing perforations require that the perforation of the plastic material be accomplished subsequent to the heat shrinkable material passing through the heat shrink oven. The prior art utilizing cut-outs in the material requires careful registry between the cut-outs and the containers to be packaged. It would be more desirable and more efficient to perforate the sheet prior to passing through the heat shrink oven since this would eliminate the critical registry of perforations required by the prior art. Unfortunately, this method and apparatus has not been heretofore accomplished in the prior art. It is well known, for example, in U.S. Pat. No. 3,545,165, that a perforation in a heat shrinkable material prior to heat shrinking will cause a severing of the heat shrinkable material along the perforation line as the heat shrinkable material is passed through the heat shrink oven.

Therefore, it is an object of this invention to provide an apparatus and method which overcomes the aforementioned inadequacies of the prior art devices and provides an improvement which is a significant contribution to the advance of the heat shrink packaging art.

Another object of this invention is to provide an apparatus and method for producing a heat shrinkable package having a frangible access panel defined by perforations wherein the perforations are applied prior to the heat shrinking of the heat shrinkable material.

Another object of this invention is to provide an apparatus and method for providing a heat shrinkable package having a frangible access panel defined by perforations which may be accomplished by existing shrink wrap packaging machines with a minimal installation of additional equipment.

Another object of this invention is to provide an apparatus and method for producing a heat shrinkable package having a frangible access panel defined by perforations which does not require a critical registration between the heat shrinkable material and the articles to be shrink wrapped.

Another object of this invention is to provide an apparatus and method for providing a heat shrinkable package having a frangible access panel defined by perforations which is applicable to all type of plastic heat shrinkable material.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention within the scope of the invention. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into an apparatus for shrink wrapping article means with a shrink wrap package having a frangible access panel. A frame is provided with support means for supporting web means of heat shrinkable material. A perforating means is interposed in the path of the heat shrinkable material for perforating a portion of the material with plural longitudinally-extending perforations to define the frangible access panel therebetween. A conveyor moves the article means through a heat sealing means and a heat shrink oven. The heat sealing means cooperates with the support means and the conveyor for wrapping the article means with the heat shrinkable material with the perforated portion of the heat shrinkable material disposed on the conveyor. The conveyor moves the article means through the oven to heat the shrinkable material while providing only limited heating of the perforated portion of the heat shrinkable material disposed on the conveyor to thereby prevent severing of the material along the perforations.

In a more specific embodiment of the invention, the perforating means comprises a first rotatable cylinder having perforating protrusions extending from an outer surface thereof for cooperation with a second rotatable cylinder biased into engagement with the first rotatable cylinder with the heat shrinkable material disposed therebetween.

The invention also may be incorporated into the method of providing a heat shrinkable package for article means with a frangible access panel. The method includes the steps of providing web means of heat shrinkable plastic material and perforating at least a portion of the web means with plural longitudinal perforations to provide the frangible access panel therebetween. The article means is wrapped with the heat shrinkable material and oriented on the conveyor with the perforated portions being immediately adjacent the conveyor. The heat shrinkable plastic material is heated for effecting the necessary shrinking while providing only limited heating of the perforated portion of the material for preventing severing of the material along the perforations.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purpose of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 1:
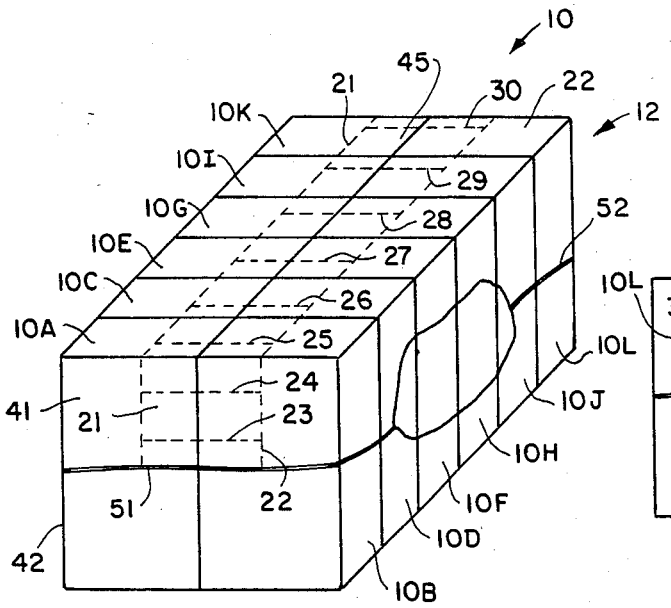
FIG. 1 is an isometric view of a heat shrinkable package made in accordance with the present invention.

FIG. 1 illustrates article means 10 in a shrink wrap package 12, shown as a plurality of articles 10A–10L arranged in an array. Although the aforesaid package is shown as a plurality of containers in an array, the present apparatus and method is applicable to a single article or container, as should be well known to those skilled in the art. The shrink wrap package 12 comprises plurality perforations shown as a first and a second perforation 21 and 22 extending longitudinally along the length of the package 12 with intermediate perforations 23–32 established perpendicular and extending between the longitudinally-extending perforations 21 and 22. The shrink wrap package 12 comprises a first sheet element 41 and a second sheet element 42 joined by a first seam 51 and a second seam 52 affixing the first sheet 41 to the second sheet 42. The longitudinally-extending perforations 21 and 22 extend between the seals 51 and 52 as shown in FIG. 2.

Figure 2:
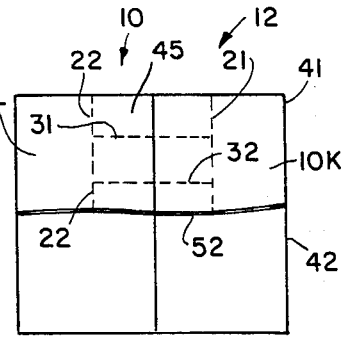
FIG. 2 is a rear elevational view of the heat shrinkable package shown in FIG. 1.
Figure 3:
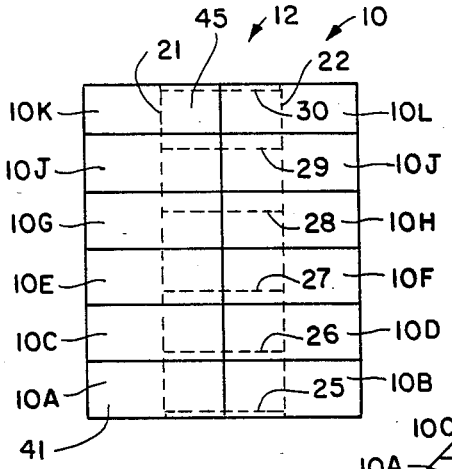
FIG. 3 is a plan view of the package shown in FIG. 1.

FIG. 2 illustrates a rear view of the package 12, whereas FIG. 3 illustrates a plan view thereof. The package shown in FIGS. 1-3 illustrates the shrink-wrap package 12 with the perforations 21-32 defining a removable access panel 45 therebetween. In this embodiment, the perforations 21, 22, 23 and 32 define the removable access panel 45 for enabling price markers to be placed on each of the plurality of article means 10A-10L.

Figure 4:
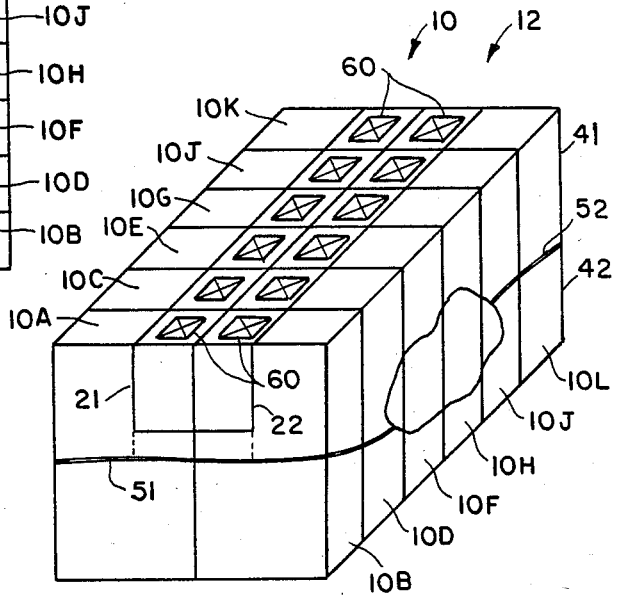
FIG. 4 is an isometric view of the package shown in FIG. 1 with the frangible access panel removed.

FIG. 4 illustrates the package 12 of FIG. 1 with the access panel 45 being removed for allowing price marker 60 to be placed thereon. The present invention has the distinct advantage of first, substantially completely overwrapping the plurality of articles 10A-10L in an array to protect the articles from being contaminated by dust, dirt and the like, and second, enabling the access panel 45 to be removed for the application of tags 60 such as price tags or tax stamps without removing the plurality of articles 10A-10L from the package 12. Since each of the individual articles 10A-10L may be accessible through the removed access panel 45 while the articles 10A-10L are still in the array price markings and/or tax stamps can be readily accomplished by an automatic machine and the like.

Heretofore in the prior art, perforations have been incorporated in the shrink wrap packaging art, but experiments have shown that the shrink wrap material will sever upon the application of heat along the line of the perforation. Accordingly, the prior art patents teach the perforation of the material subsequent to the heat shrinking process. The perforation of the material subsequent to the heat shrinking process is not only costly but requires proper orientation of the article to efficiently produce perforations along the package. The present apparatus and method overcomes the inadequacies of the prior art and allows for the perforation of the heat shrinkable material prior to the heat shrinking process. Accordingly, conventional heat shrinking machines may be modified for use with the present invention.

Figure 5:
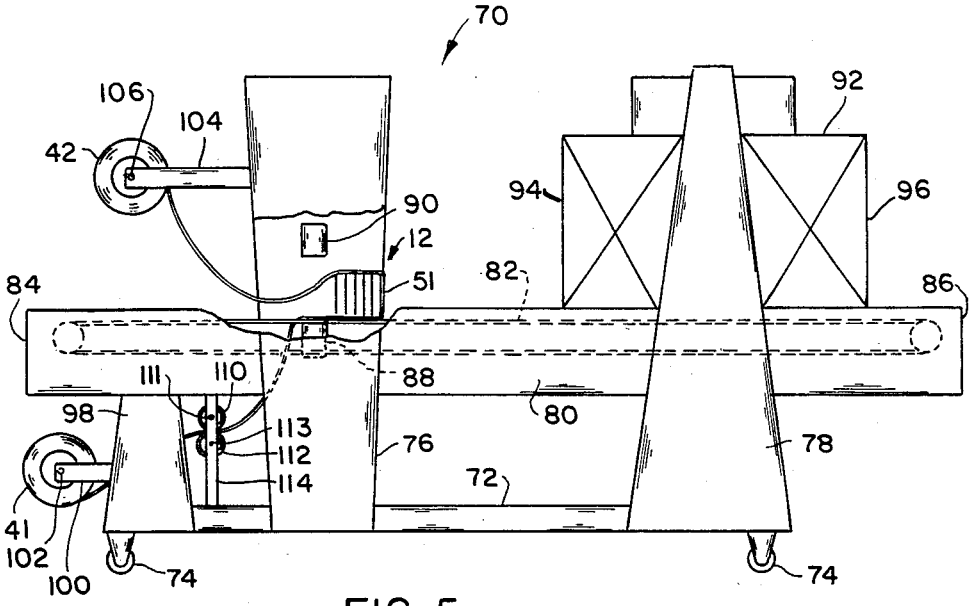
FIG. 5 is a side elevational view of an apparatus for providing the heat shrinkable package shown in FIGS. 1–4.

FIG. 5 is a side elevational view of an apparatus 70 for heat shrinking plastic sheet material to provide the packages as shown in FIGS. 1-4. The apparatus includes a base 72 having wheels 74 with the base 72 supporting columns 76 and 78. A frame 80 is supported by the columns 76 and 78 and comprises a conveyor 82 for moving articles from a first end 84 to a second end 86. Reciprocal heat sealing jaws 88 and 90 create seams 51 and 52 from the heat shrinkable material, as should be well known to those skilled in the art. A heat shrink oven 92 includes an input 94 and an output 96 with suitable heat retardant barriers therein (not shown). The base 72 supports a subcolumn 98 having a bracket 100 for rotatably mounting web means comprising the first heat shrinkable material 41 on an axis 102. Column 76 similarly has a bracket 104 for rotatably mounting web means comprising the second heat shrinkable material 42 on axis 106.

Then first heat shrinkable material 41 is passed between perforating means comprising a first perforating cylinder 110 rotatably mounted on a shaft 111 and a second a backing cylinder 112 rotatably mounted on a shaft 113. Shafts 111 and 113 are mounted to a support 114. The perforating means includes means for biasing the first and second cylinders 110 and 112 into contact with the heat shrinkable material 41. The biasing may be acomplished by various suitable means such as spring biasing, gravity biasing and the like.

Figure 6:
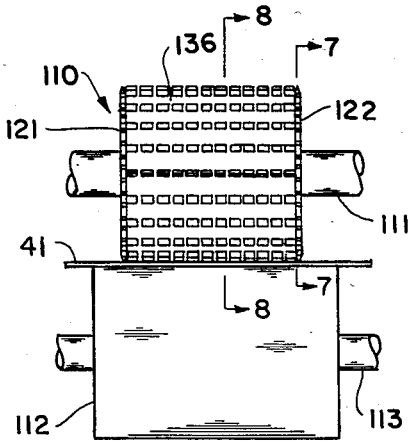
FIG. 6 is an enlarged front view of the perforating means shown in FIG. 5.
Figure 7:
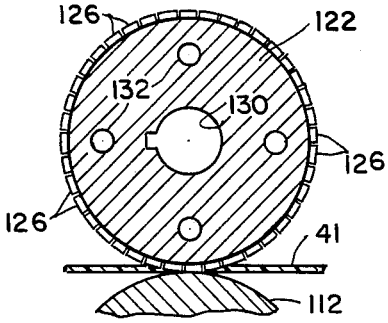
FIG. 7 is a sectional view along line 7—7 of FIG. 6.

FIG. 6 is a front elevational view of the first perforating cylinder 110 and the second backing cylinder 112. In this embodiment the perforating cylinder 110 comprises end disks 121 and 122 shown more fully with reference to FIG. 7 for perforating the longitudinal perforations 21 and 22 as shown in FIGS. 1-4. End disk 122 includes a plurality of cutting edges 126 formerly distributed out the periphery of the disk 122. Cutting edges 126 create the longitudinal perforations in the first sheet of plastic material 41 as the end disk 112 is biased against the backing cylinder 112 with the sheet material 41 disposed therebetween. End disk 122 has an aperture 130 for accommodating shaft 111 with a plurality of bores 132 for securing the end disks 121 and 122 to the interior of a central drum 136 by conventional mechanical fasteners. The end disk 121 operates in a similar manner.

Figure 8:
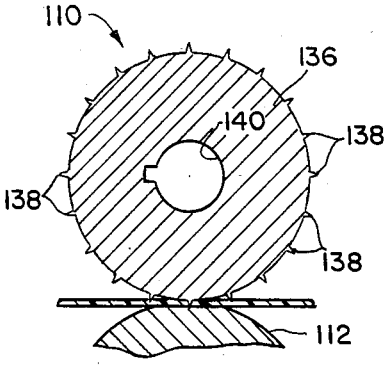
FIG. 8 is a sectional view along line 8—8 of FIG. 6.

The central drum 136, as shown more fully in FIG. 8 has a plurality of cutting edges 138 for providing the perforations 23-32 as shown in FIG. 1-4. The bias of the perforating cylinder 110 against the backing cylinder 112 provides the spaced perforations as shown in FIGS. 1-4. Aperture 140 within the cylinder 136 receives shaft 111, which should be well know to those skilled in the art. It should be appreciated by those skilled in the art that the assembly configuration of the perforating cylinder comprising end disks 121 and 122 and a central cylinder 136 enables various perforation patterns to be created, depending upon the specific application of the packages to be overwrapped the plurality of transverse intermittently-spaced perforations 23-32 extending between the plural longitudinal perforations 21-22 define a plurality of individual smaller frangible access panels therebetween and within frangible access panel 45.

Figure 9:
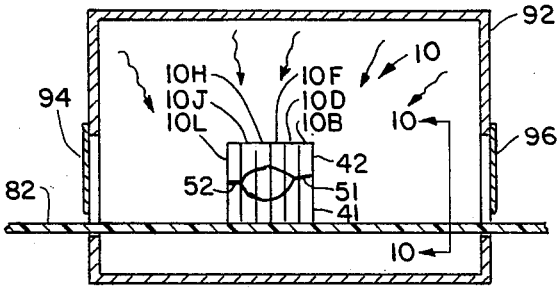
FIG. 9 is an enlarged sectional view showing the orientation of the heat shrinkable package on a conveyor belt passing through the heat shrink oven of FIG. 5.
Figure 10:
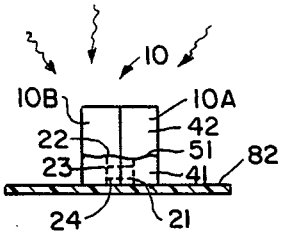
FIG. 10 is a view along line 10—10 in FIG. 9.

FIGS. 9 and 10 are interior views of the package within the heat shrink area 92. Since the perforation by the perforating cylinder 111 is accomplished on the lower web of heat shrinkable material 41 and, accordingly, the perforated material is disposed directly on the conveyor 82. Accordingly, the conveyor 82 limits the heat being applied to the first sheet material 41 in relation to the heat provided to the second sheet material 42. The differential in heat being applied to the first and second sheets 41 and 42 enable the package 12 to be completely heat shrunk without the severing of the sheet material along the perforations 21-32 as heretofore known in the prior art. It is conventional for price marking and/or tax stamps to be applied to the upper surface of a container. Accordingly, it was conventional in the heat shrinking art to heat shrink packages in the upright position. However, in this embodiment, the packages are heat shrunk in an upside-down position to provide the differential in heat between the first and second sheets 41 and 42, as shown in FIGS. 9 and 10.

Various types of conventional heat-shrinkable material can be utilized with the present invention. For each of the different types of material, it should be appreciated that the speed of the conveyor and the temperature of the oven must be properly adjusted in order to completely heat shrink the package while simultaneously inhibiting the first sheet material 41 from severing along the lines of the perforation. The adjustment of the conveyor speed, the selection of plastic material, and the temperature of the oven are within the skill of those knowledgeable in the heat shrinking art upon understanding the present invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The method of providing a heat shrinkable package with a plurality of frangible access panels for a plurality of articles arranged in an array, comprising the steps of:

providing a first and a second web of heat shrinkable plastic material with the first web being immediately adjacent the conveyor;

perforating the first web with plural longitudinal perforations extending along the length of the first web and further perforating the first web with transverse intermittently-spaced perforations extending between the plural longitudinal perforations to define the frangible access panels therebetween;

heat sealing the first web to the second web to create a first seam;

draping the articles between the first and second webs;

heat sealing the first web to the second web to create a second seam with the articles enclosed therein; and passing the articles through a heat shrink oven on the conveyor for shrinking the first and second webs with the first web being immediately adjacent the conveyor and while providing only limited heating of the first web adjacent the conveyor for preventing severing of the first web along the perforations thereby enabling the desired number of access panels to be removed without destroying the mechanical package for holding the plurality of articles in an array.

2. The method as set forth in claim 1, including the steps of removing the desired number of frangible access panels to expose a portion of each of the plurality of articles to enable price markers, tax stamps and the like to be placed on each of the plurality of articles in the array.

3. The method as set forth in claim 1, wherein the plural longitudinal perforations extend substantially parallel to one another.

* * * * *